US006267065B1

(12) United States Patent
Lin

(10) Patent No.: US 6,267,065 B1
(45) Date of Patent: Jul. 31, 2001

(54) FOLDABLE PAPERBOARD TABLE

(76) Inventor: Joseph Jui-Chin Lin, 1455 San Marino Ave., 2nd Fl., San Marino, CA (US) 91108

( * ) Notice: Subject to any disclaimer, the term of this patent is extended or adjusted under 35 U.S.C. 154(b) by 0 days.

(21) Appl. No.: 09/482,344

(22) Filed: Jan. 14, 2000

(51) Int. Cl.[7] ..... A47B 13/00
(52) U.S. Cl. ..... 108/157.14; 108/165; 108/180
(58) Field of Search ..... 108/157.14, 153.1, 108/157.16, 157.15, 157.18, 162, 165.18

(56) References Cited

U.S. PATENT DOCUMENTS 1,903,631 * 4/1933 Morrison ..... 108/157.14 X
1,940,117 * 12/1933 Carpos ..... 108/157.18
2,361,875 * 10/1944 Sachs ..... 108/165
3,714,908 * 2/1973 Notko ..... 108/157.14
3,871,726 * 3/1975 Stegner ..... 108/157.14 X

FOREIGN PATENT DOCUMENTS

2203034 * 10/1988 (GB) ..... 108/157.14

* cited by examiner

*Primary Examiner*—Jose V Chen
(74) *Attorney, Agent, or Firm*—Rosenberg, Klein & Lee

(57) ABSTRACT

A foldable paperboard table includes two first paperboards each having two first slits on lower edge thereof and two second paperboards each having two second slits on a top edge thereof. The four paperboards are interconnected with each other by engaging the first slits with the second slits to become a base portion. A top having flaps is connected to a top of the base portion and each flap has a side slit so that the flaps are folded to let each side of the first paperboards and the second paperboards engage with the side slits of the flaps to secure the top.

6 Claims, 6 Drawing Sheets

A — A

FOLDABLE PAPERBOARD TABLE

FIELD OF THE INVENTION

The present invention relates to a table made of paperboards. The paperboards includes four base parts, a cruciform frame and a top which are engaged with each other by inserting one paperboard into slits in the other paperboard.

BACKGROUND OF THE INVENTION

A conventional table suitable to be carried outdoor generally is made of metal tubes and a board which is pivotably connected to the metal tubes. The table can be folded to become a compact size so as to be conveniently carried or put in trunk of a car. Nevertheless, the conventional foldable table is still heavy in weight and the space that the folded table occupies is large. The connection between the tubes uses a lot of hooks, links or the like and these small parts could hurt the users' fingers. Furthermore, the foldable table is not a homogenous shape because there are a lot of protrusion portions such as the legs which make the foldable table be difficult to be properly stored in a limited space such as the trunk of a car.

The present invention intends to provide a foldable table that is made of paperboards which are engaged with each other by inserting one paperboard into slits in the other paperboards. The paperboards are easily to be disengaged from each other and can be overlapped with each other to become a thin pile of paperboards.

SUMMARY OF THE INVENTION

In accordance with one aspect of the present invention, there is provided a paperboard table comprising two first paperboards each having two first slits defined in a lower edge thereof. Two first side slits are respectively defined in two sides of each first paperboard. Two second paperboards each have two second slits defined in the top edge thereof and two second side slits are defined in two sides of each second paperboard. The two first paperboards are respectively connected between the two second paperboards by inserting the two first paperboards into the two second slits. A top has four sides and each side has a side flap extending therefrom. Each side flap has two engaging slits defined in a distal edge thereof The top is removably located on the respective top edge of the two first paperboards and the two second paperboards. The side flaps are respectively folded and the engaging slits of the side flaps are engaged with the first side slits of the two first paperboards and the second side slits of the two second paperboards.

The object of the present invention is to provide a table that is composed by paperboards so that the table has light weight and can be easily assembled and/or disengaged apart.

Another object of the present invention is to provide a table that can be disengaged into sheets of paperboards which are piled to become a compact size.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 is a perspective view to show a foldable paperboard table of the

DETAILED DESCRIPTION OF THE PREFERRED EMBODIMENT

Figure 1:
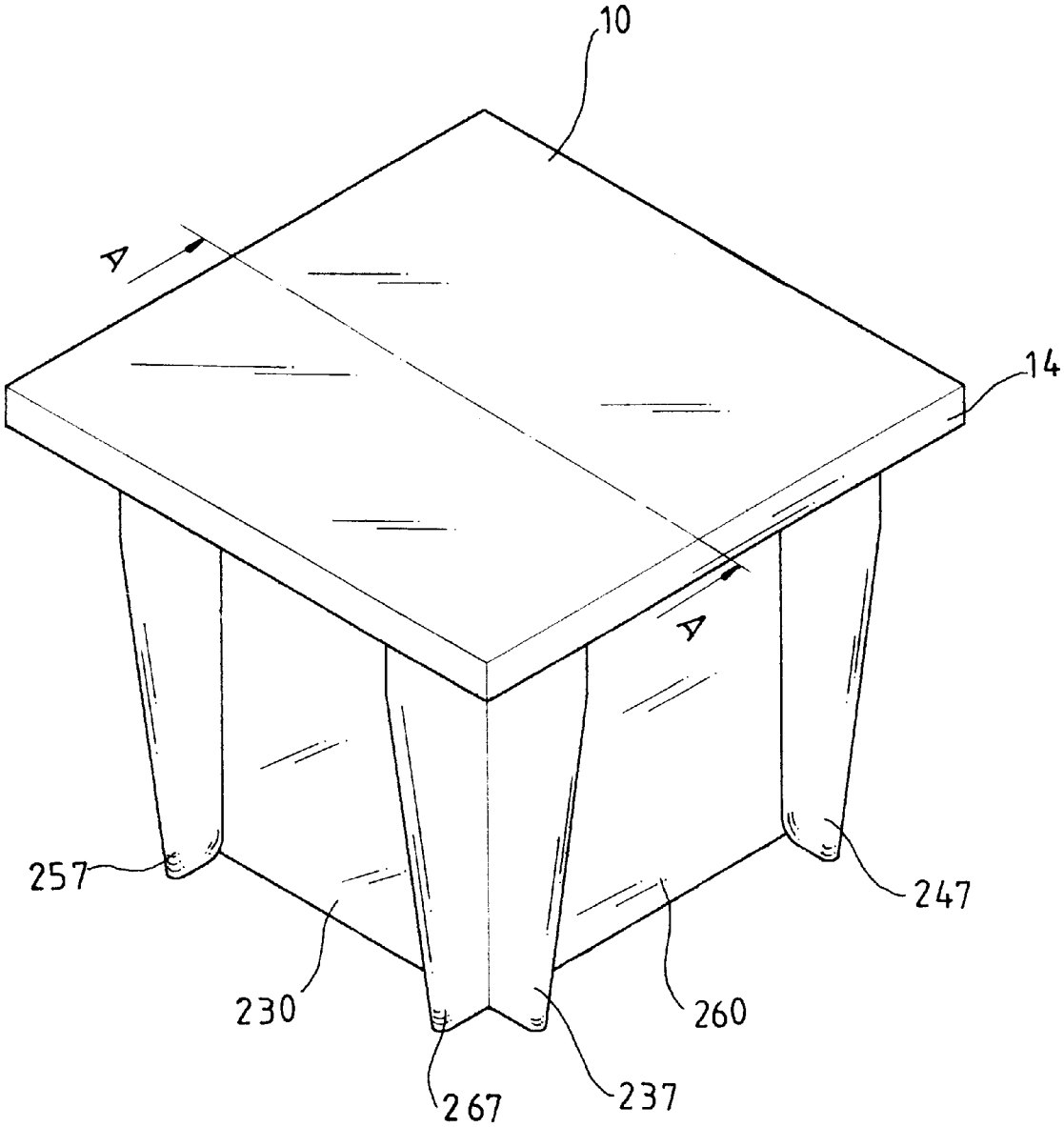
Figure 2:
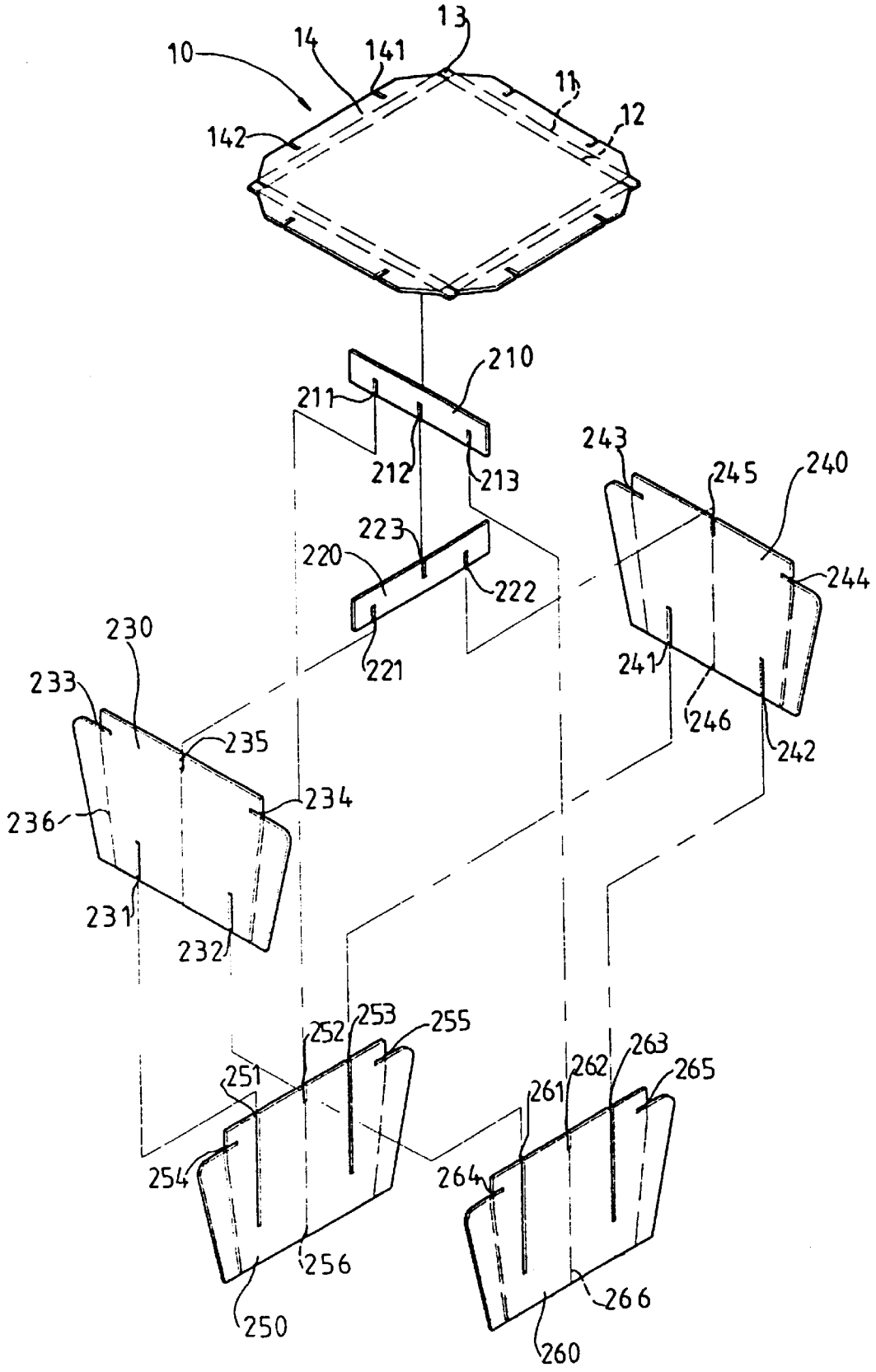
FIG. 2 is an exploded view to show the foldable paperboard table of the present invention.
Figure 3:
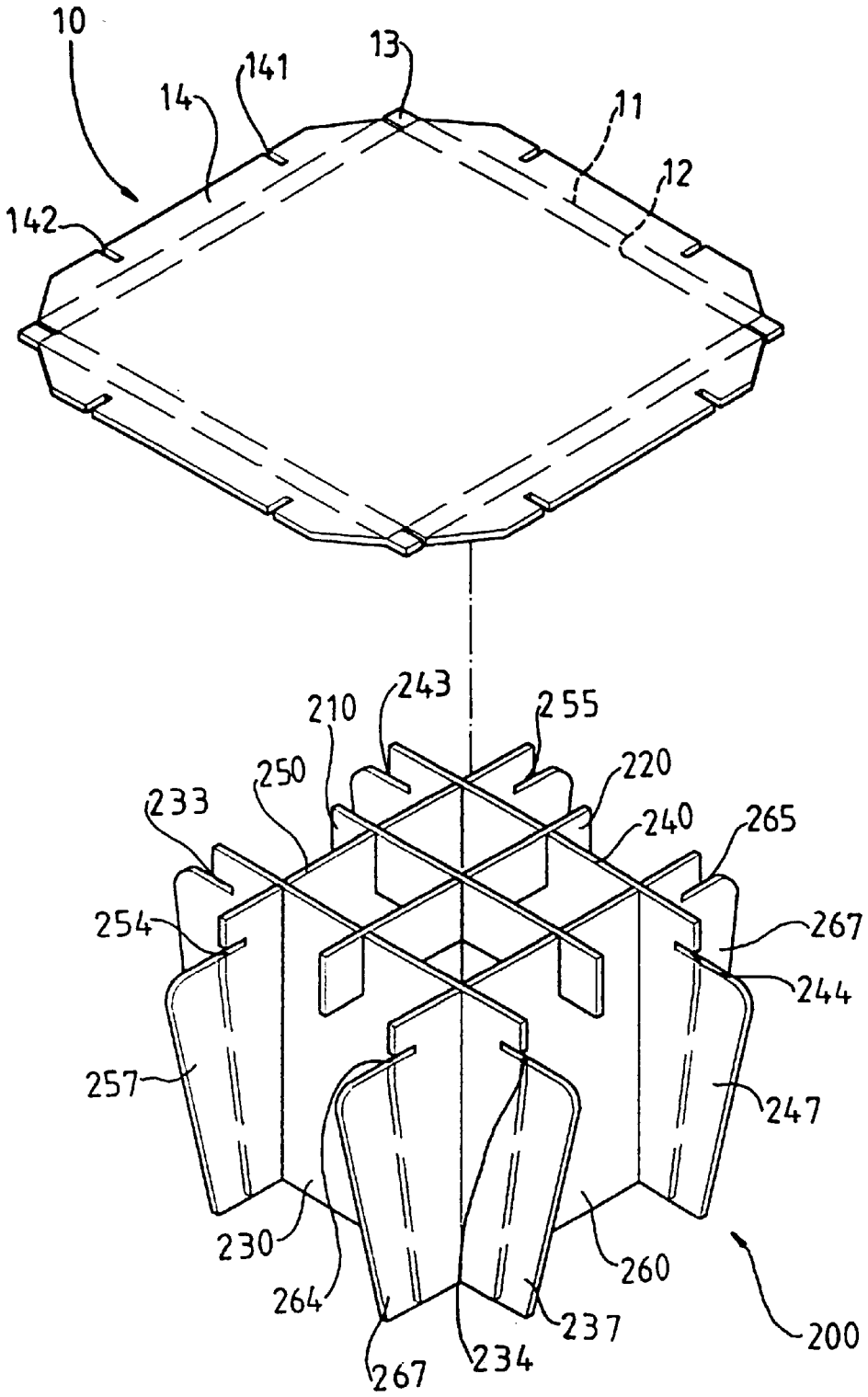
FIG. 3 is an exploded view to show a top and a base portion of the foldable paperboard table of the present invention.
Figure 4:
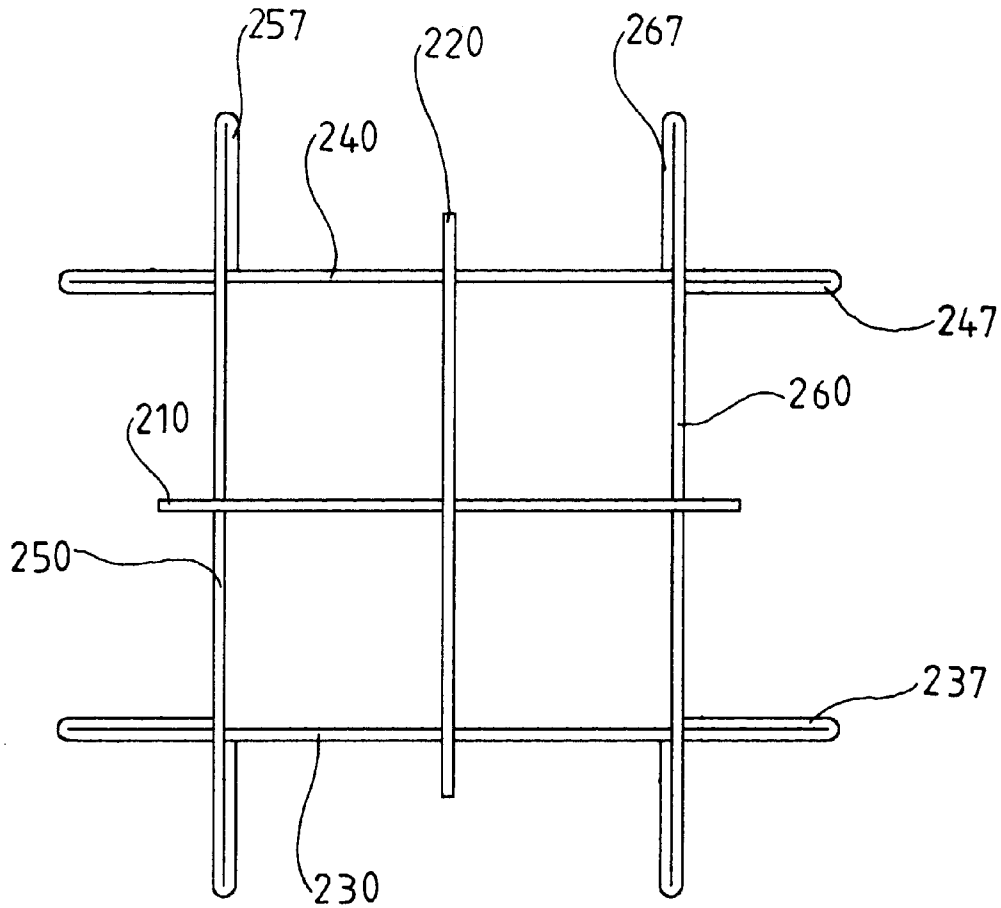
FIG. 4 is a top view to show the base portion of the table of the present invention.

Referring to FIGS. 1 to 4, the foldable paperboard table in accordance with the present invention comprises a base portion 200 which includes two first paperboards 230, 240 and two second paperboards 250, 260. Each first paperboard 230/240 has a top edge and a lower edge. Two first slits 231, 232/241, 242 are defined in a lower edge of each first paperboard 230/240. Two first side slits 233, 234/243, 244 are respectively defined in two sides of each first paperboard 230/240. The two second paperboards 250, 260 each have a top edge and a lower edge. Two second slits 251, 253/261, 263 are defined in the top edge of each second paperboard 250/260. Two second side slits 254, 255/264, 265 are respectively defined in two sides of each second paperboard 250/260. A central folding line 236/246/256/266 is defined in each of the first paperboards 230, 240 and each of the second paperboards 250, 260. A central slit 235/245/253/262 is defined in the top edge of each first paperboard 230/240 and each second paperboard 250/260.

A panel 237/247/257/267 extends from each side of each of the first paperboards 230, 240 and the second paperboards 250, 260. The panel 237/247 on each first paperboard 230/240 is located below the first side slit 233, 234/243, 244, and the panel 257/267 on each second paperboard 250/260 is located below the second side slits 254, 255/264, 265. The two first paperboards 230, 240 are respectively connected between the two second paperboards 250, 260 by inserting the two first paperboards 230, 240 into the two second slits 251, 253/261, 263. A lower edge of each second paperboards 250/260 is respectively engaged with the first slits 231, 241/232, 242 of the two opposite first paperboards 230, 240. Each panel 237/247/257/267 is folded and overlapped to the side from which it extends so as to enforce the structural strength.

A cruciform frame includes two plates 210, 220 has a connection slit 211/222/221/213 defined in four ends of the cruciform frame. Each of the two plates 210, 220 has a top slit 212/223 so that the two plates 210, 220 are engaged with each other by engaging the two top slits 212, 223 together. The cruciform frame is engaged with the first paperboards 230, 240 and the second paperboards 250, 260 by engaging the connection slits 211, 222, 221, 213 with the four central slits 235, 245, 253, 262 of the first paperboards 230, 240 and the second paperboards 250, 260.

Figure 5:
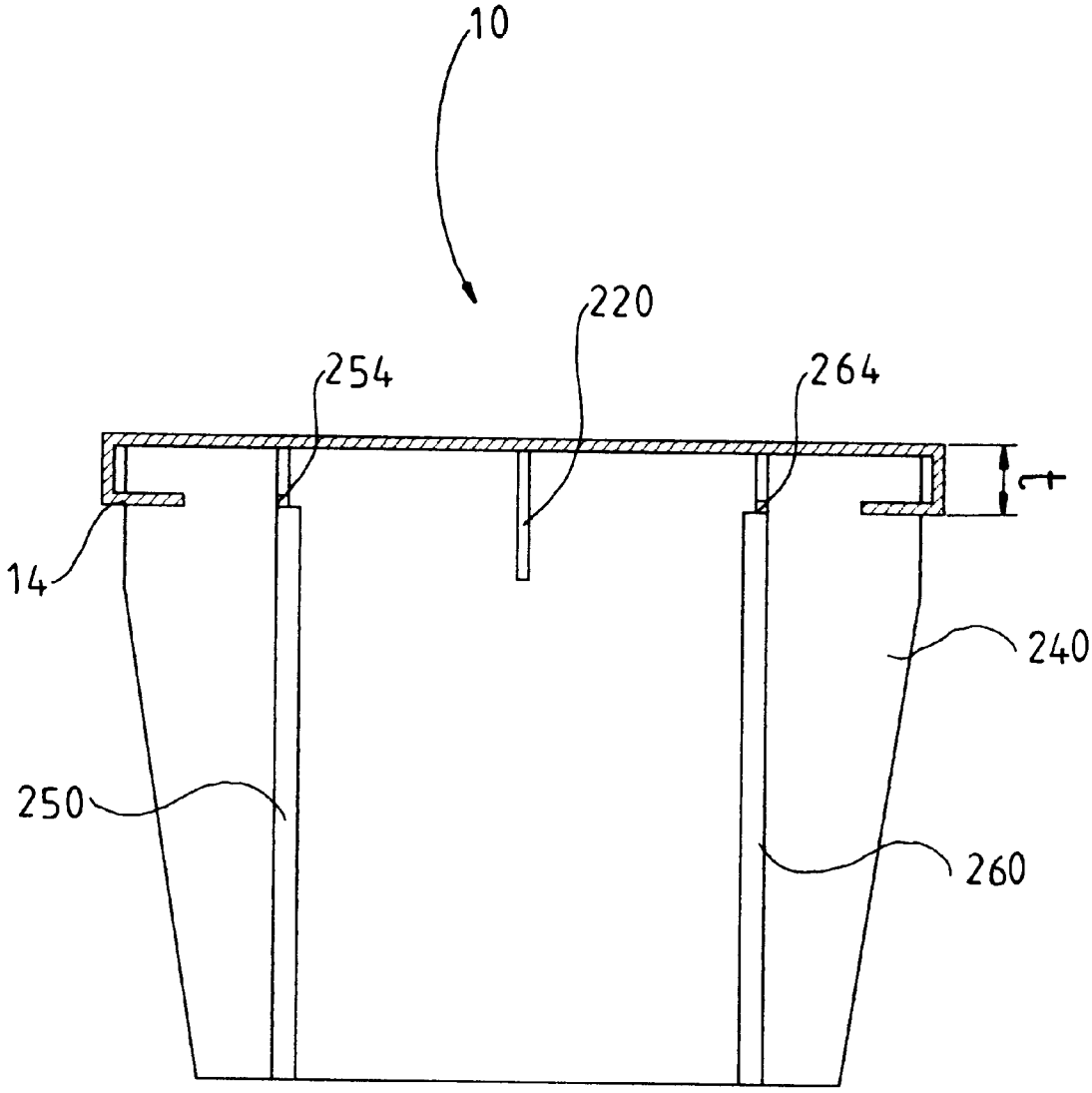
FIG. 5 is a side elevational view to show the flaps engaged with the base portion of the table of the present invention.

A top 10 has four sides and each side has a side flap 14 extending therefrom. Two parallel folding lines 11, 12 are defined between each side of the top 10 and the side flap 14 extending from the top 10. Two connection plates 13 respectively extend from two ends of each area between the two parallel folding lines 11, 12. Each side flap 14 has two engaging slits 141, 142 defined in a distal edge thereof so that the top 10 is removably secured on the respective top edge of the two first paperboards 230, 240 and the two second paperboards 250, 260. The side flaps 14 are folded along the two folding lines 11, 12 and the engaging slits 141, 142 of the side flaps 14 are engaged with the first side slits 232, 233/243, 244 of the two first paperboards 230, 240 and the second side slits 254, 255/264, 265 of the two second paperboards 250, 260. The connections 13 are folded and secured to close each end of the area between the two folding lines 11, 12 so that there will be a thickness "t" as shown in FIG. 5 defined between the two parallel folding lines 11, 12, and the top 10 can support a large load.

Figure 6:
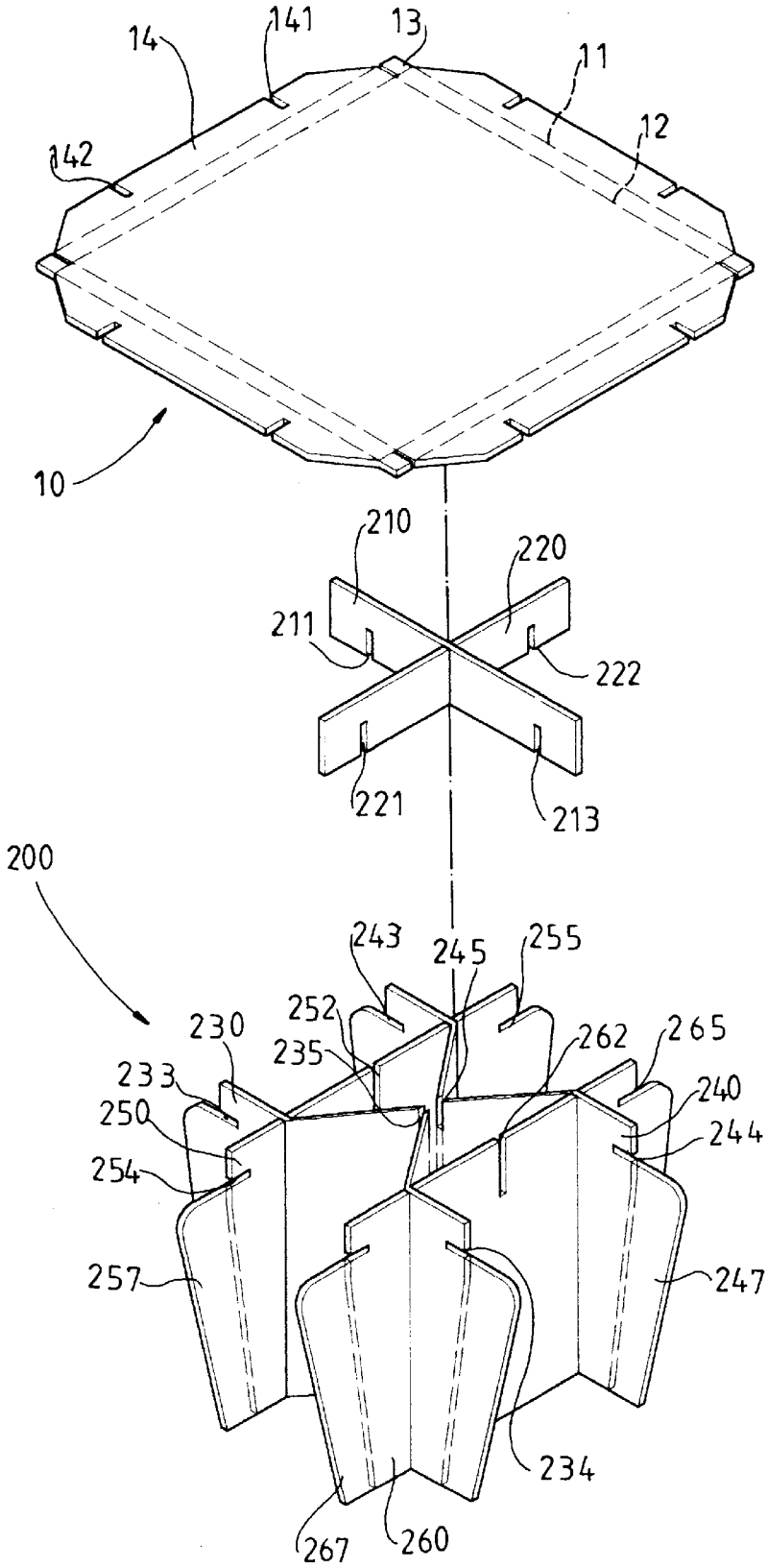
FIG. 6 is an exploded view to show the table wherein the two paperboards of the base portion are folded along the central folding lines.

As shown in FIG. 6, the first paperboards 230, 240 are able to be respectively folded along the central folding lines 236, 246 so as to let the base portion 200 of the table become a compact size when folding the table.

The table of the present invention is easily to be assembled and/or disengaged apart. The parts consisting the table are environment friendly and has a light in weight. Necessary water proof treatment is applied to each part of the table of the present invention so that the table can be used in different climate conditions.

While we have shown and described various embodiments in accordance with the present invention, it should be clear to those skilled in the art that further embodiments may be made without departing from the scope and spirit of the present invention.

What is claimed is:

1. A paperboard table comprising:

two first paperboards each having a top edge portion and a lower edge portion, two first slits defined in a lower edge portion of each first paperboard, two first side slits respectively defined in two side portions of each first paperboard;

two second paperboards each having a top edge portion and a lower edge portion, two second slits defined in said top edge portion of each second paperboard, each second paperboard having two second side slits defined in two side portions thereof, said two first paperboards respectively connected between said two second paperboards by inserting said two first paperboards into said two second slits, a lower edge portion of each second paperboard respectively engaged with said first slits of said first paperboards, and a top having four sides and each side having a side flap extending therefrom, each side flap having two engaging slits defined in a distal edge portion thereof, said top removably being located on said respective top edges of said two first paperboards and said two second paperboards, said side flaps being folded and said distal edge portions of said side flaps engaging said first side slits of said two first paperboards and said second side slits of said two second paperboards, said engaging slits engaging said side portions of said first and second paperboards.

2. The table as claimed in claim 1 further comprising two parallel folding lines defined between each side of said top and said extension panel extending from said top.

3. The table as claimed in claim 2 further comprising two connection plates respectively extending from two ends of each area between said two parallel folding lines.

4. The table as claimed in claim 1 further comprising a central folding line defined in each of said first paperboards and each of said second paperboards.

5. The table as claimed in claim 1 further comprising a panel extending from each side portion of each of said first paperboards and said second paperboards, said panels on each first paperboard being located below said first side slits, said panels on each second paperboard being located below said second side slits.

6. The table as claimed in claim 1 further comprising a central slit defined in said top edge portion of each first paperboard and each second paperboard, and a cruciform frame having a connection slit defined in each of four ends thereof, said cruciform frame engaging said four central slits of said first paperboards and said second paperboards, said connection slits engaging said top edge portions of said first and second paperboards.

* * * * *